US007343957B2

(12) United States Patent
Lin

(10) Patent No.: US 7,343,957 B2
(45) Date of Patent: Mar. 18, 2008

(54) GUIDE ROLLER SEAT FOR CORD OF WINDOW COVERING

(76) Inventor: Shih-Ming Lin, 5F-3, No. 35, Taishan 3th St., Fuquan Li, Xi District, Jiayi (TW)

( * ) Notice: Subject to any disclaimer, the term of this patent is extended or adjusted under 35 U.S.C. 154(b) by 219 days.

(21) Appl. No.: 11/253,171

(22) Filed: Oct. 18, 2005

(65) Prior Publication Data

US 2007/0084569 A1 Apr. 19, 2007

(51) Int. Cl.
*E06B 9/322* (2006.01)

(52) U.S. Cl. ..... 160/168.1 R; 160/173 R; 160/170

(58) Field of Classification Search ..... 160/168.1 R, 160/170, 171, 173 R, 178.1 R, 178.2, 84.04, 160/84.05, 84.01
See application file for complete search history.

(56) References Cited

U.S. PATENT DOCUMENTS 1,949,653 A * 3/1934 Moore ..... 160/170
6,725,897 B2 * 4/2004 Palmer ..... 160/168.1 R
6,761,203 B1 * 7/2004 Huang ..... 160/170
6,837,294 B2 * 1/2005 Cheng et al. ..... 160/84.04
2006/0096719 A1 * 5/2006 Wu ..... 160/170
2006/0137830 A1 * 6/2006 Lin ..... 160/84.04
2007/0107854 A1 * 5/2007 Jelic ..... 160/170

* cited by examiner

*Primary Examiner*—Blair M. Johnson
(74) *Attorney, Agent, or Firm*—Alan Kamrath; Kamrath & Associates PA

(57) ABSTRACT

A guide roller seat for a window covering includes a seat body, and a plurality of guide rollers rotatably mounted in the seat body to guide movement of a cord which is extended between an automatic winding mechanism and a covering body of the window covering. Thus, the cord is kept with a determined tension by the drawing action of the guide rollers, so that the cord is drawn by guidance of the guide rollers so as to fold or extend the covering body smoothly and evenly, thereby preventing the covering body from being tilted during the drawing action of the cord.

14 Claims, 9 Drawing Sheets

GUIDE ROLLER SEAT FOR CORD OF WINDOW COVERING

BACKGROUND OF THE INVENTION

1. Field of the Invention

The present invention relates to a guide roller seat, and more particularly to a guide roller seat for guiding a cord of a window covering, such as a Venetian blind or the like.

2. Description of the Related Art

A conventional window covering 6 in accordance with the prior art shown in FIG. 9 comprises a headrail 60, an automatic winding mechanism 62 mounted on the headrail 60, a covering body 64 mounted on and extended from the headrail 60, a bottom rail 68 mounted on the bottom of the covering body 64, and a cord 66 extended between the automatic winding mechanism 62 and the covering body 64. The cord 66 is driven by the automatic winding mechanism 62 to fold or extend the covering body 64. However, the cord 66 is directly extended outward from the headrail 60 and attached to the covering body 64, so that the cord 66 is easily pulled by an external force. Thus, when the external force is not evenly distributed on the cord 66, the cord 66 at one side of the headrail 60 is pulled upward, while the cord 66 at another side of the headrail 60 is not pulled by the external force, so that the covering body 64 easily tilts.

SUMMARY OF THE INVENTION

In accordance with the present invention, there is provided a guide roller seat, comprising a seat body, and a plurality of guide rollers rotatably mounted in the seat body to guide movement of a cord which is extended between an automatic winding mechanism and a covering body of a window covering.

The primary objective of the present invention is to provide a guide roller seat for guiding a cord of a window covering.

Another objective of the present invention is to provide a guide roller seat, wherein the cord is kept at a normal state with a determined tension by a drawing action of the guide rollers of the guide roller seat, so that the cord has a determined tension to counteract an unevenly external force and to guide the unevenly external force to a correct direction, thereby preventing the cord at one side of the headrail from being pulled or loosened excessively due to the unevenly external force.

A further objective of the present invention is to provide a guide roller seat, wherein the cord is drawn by guidance of the guide rollers of the guide roller seat so as to fold or extend the covering body smoothly and evenly, thereby preventing the covering body from being tilted, so that the covering body is kept at a horizontal state constantly during the drawing action of the cord, thereby facilitating a user operating the cord, and thereby enhancing the outer appearance of the covering body.

A further objective of the present invention is to provide a guide roller seat, wherein when the position of the cord is changed by the automatic winding mechanism, each of the guide rollers is driven by the cord to move in the respective track, so that the cord is driven by the automatic winding mechanism smoothly by movement of the guide rollers to prevent the cord from being tangled on the automatic winding mechanism, thereby facilitating operation of the cord.

A further objective of the present invention is to provide a guide roller seat, wherein the guide roller seat is arranged in a tangential direction of the automatic winding mechanism, and the cord is reeved through each of the guide rollers of the guide roller seat in a tangential direction thereof, thereby preventing the cord from slipping leftward and rightward relative to the guide rollers of the guide roller seat, so that the cord is moved smoothly, thereby facilitating a user operating the cord.

Further benefits and advantages of the present invention will become apparent after a careful reading of the detailed description with appropriate reference to the accompanying drawings.

DETAILED DESCRIPTION OF THE INVENTION

Figure 1:
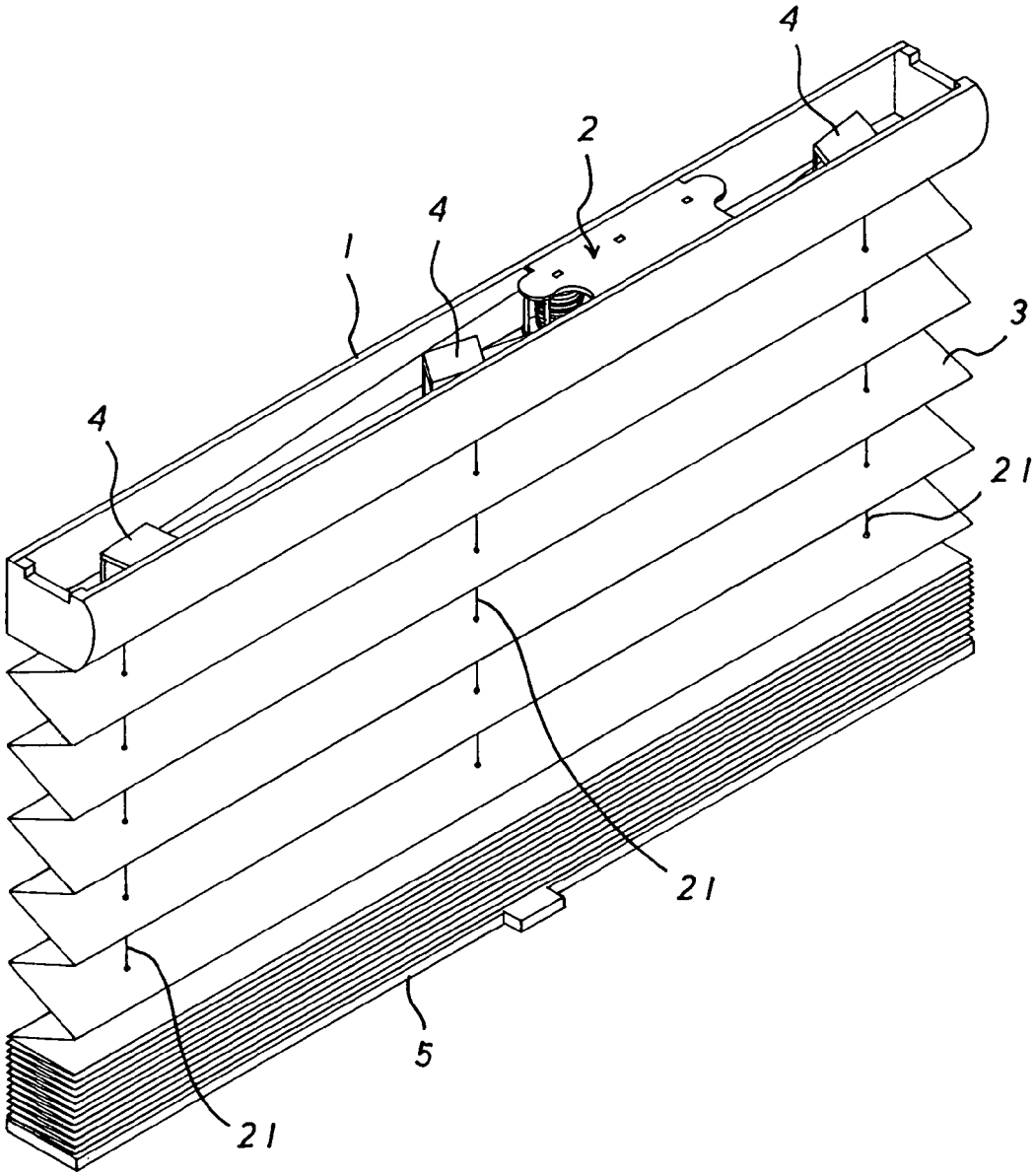
FIG. 1 is a perspective view of a window covering in accordance with the preferred embodiment of the present invention.
Figure 2:
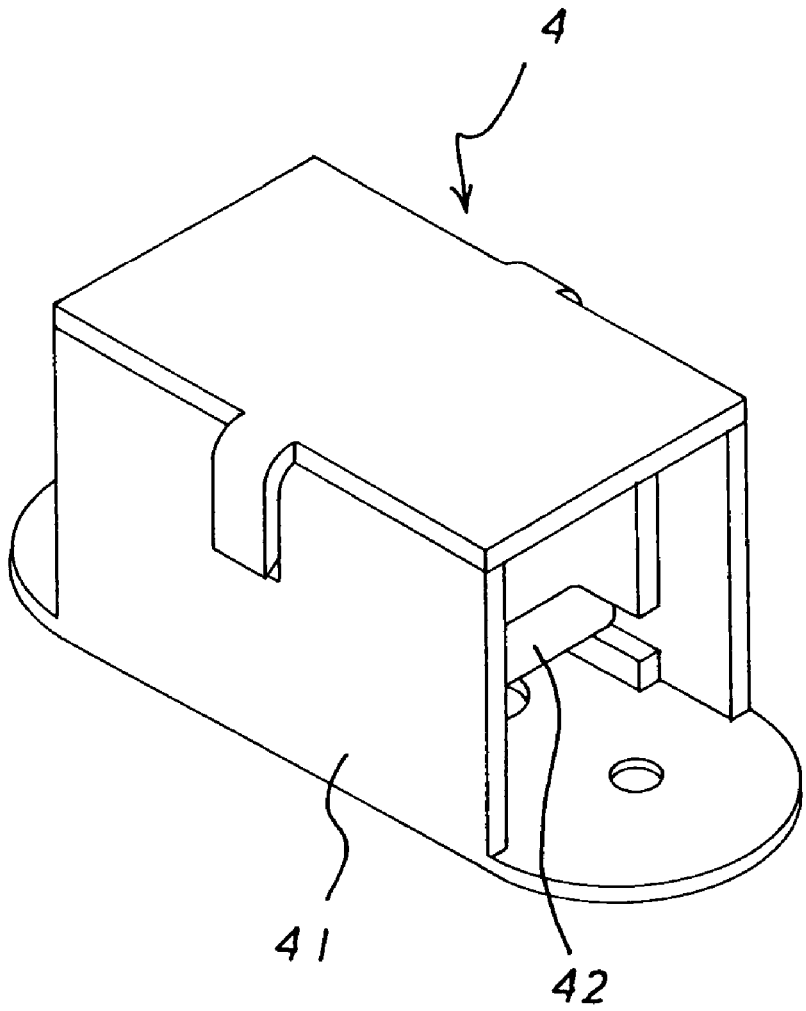
FIG. 2 is a perspective view of a guide roller seat in accordance with the preferred embodiment of the present invention.

Referring to the drawings and initially to FIG. 1, a window covering in accordance with the preferred embodiment of the present invention comprises a headrail 1, an automatic winding mechanism 2 mounted on the headrail 1, a covering body 3 mounted on and extended from the headrail 1, and a cord 21 extended between the automatic winding mechanism 2 and the covering body 3. The cord 21 is driven by the automatic winding mechanism 2 to fold or extend the covering body 3.

Referring to FIGS. 1-4, a guide roller seat 4 in accordance with the preferred embodiment of the present invention is mounted on the headrail 1 of the window covering to guide movement of the cord 21 of the window covering. The guide roller seat 4 comprises a seat body 41 mounted in the headrail 1, and a plurality of guide rollers 42 rotatably mounted in the seat body 41 to guide movement of the cord 21. The cord 21 is reeved through each of the guide rollers 42 of the guide roller seat 4 and extended outward from the seat body 41 of the guide roller seat 4.

In such a manner, the cord 21 is kept at a normal state with a determined tension by a drawing action of the guide rollers 42 of the guide roller seat 4, so that the cord 21 has a determined tension to counteract an unevenly external force and to guide the unevenly external force to a correct direction, thereby preventing the cord 21 at one side of the headrail 1 from being pulled or loosened excessively due to the unevenly external force.

Thus, the cord 21 is drawn by guidance of the guide rollers 42 of the guide roller seat 4 so as to fold or extend the covering body 3 smoothly and evenly, thereby preventing the covering body 3 from being tilted, so that the covering body 3 is kept at a horizontal state constantly during the drawing action of the cord 21, thereby facilitating a user operating the cord 21, and thereby enhancing the outer appearance of the covering body 3.

Alternatively, the guide roller seat 4 can be mounted on a bottom rail 5 of the window covering to guide movement of the cord 21 of the window covering.

Figure 5:
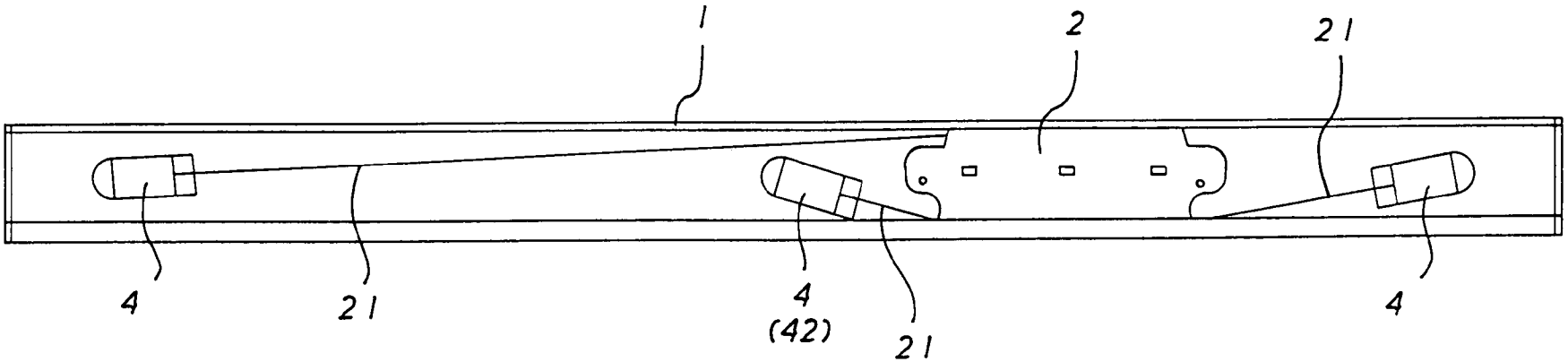
FIG. 5 is a top plan view of the guide roller seat as shown in FIG. 2.

Referring to FIG. 5, the guide roller seat 4 is arranged in a tangential direction of the automatic winding mechanism 2, and the cord 21 is reeved through each of the guide rollers 42 of the guide roller seat 4 in a tangential direction thereof, thereby preventing the cord 21 from slipping leftward and rightward relative to the guide rollers 42 of the guide roller seat 4, so that the cord 21 is moved smoothly, thereby facilitating a user operating the cord 21.

Figure 3:
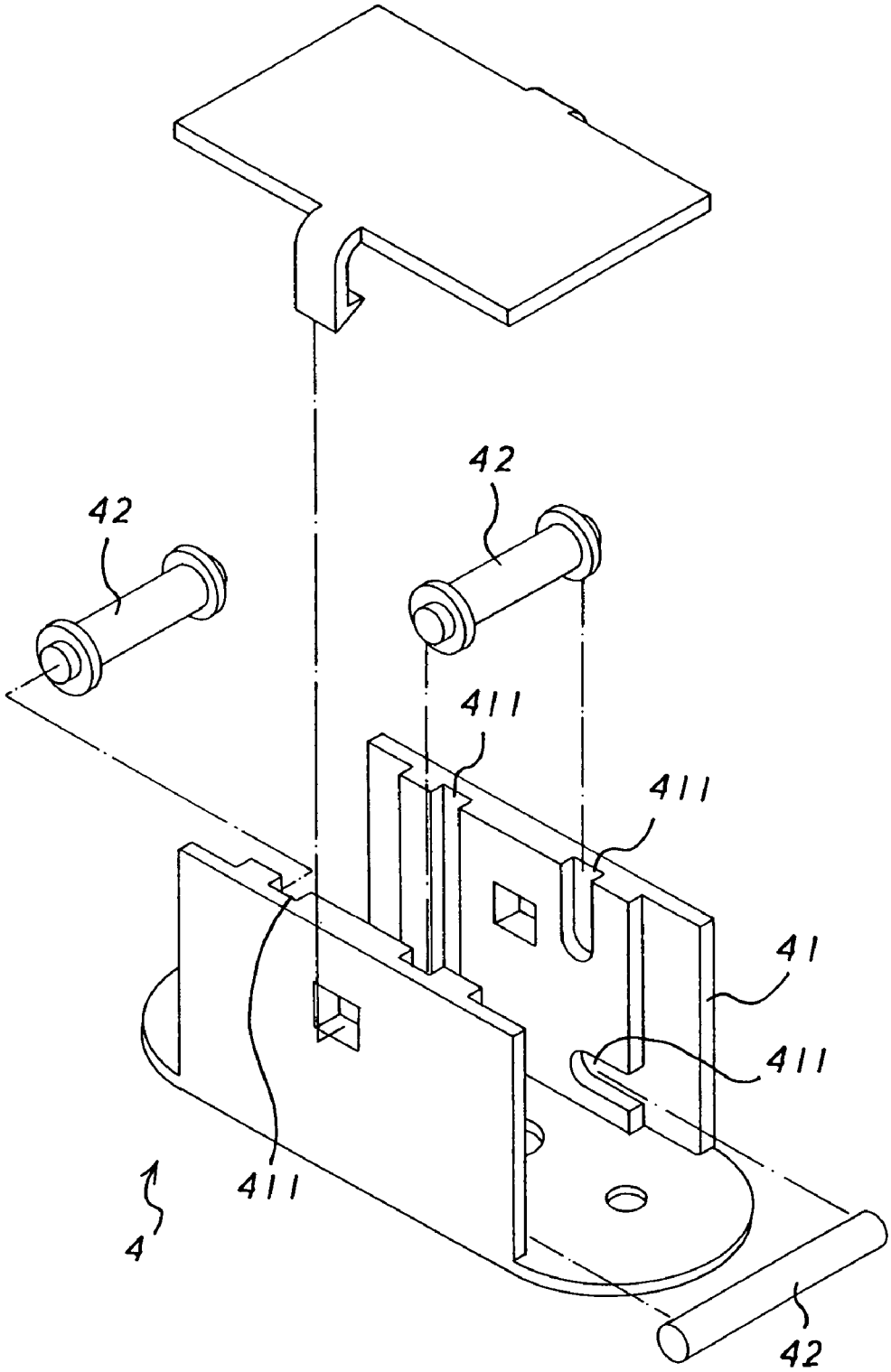
FIG. 3 is an exploded perspective view of the guide roller seat as shown in FIG. 2.
Figure 4:
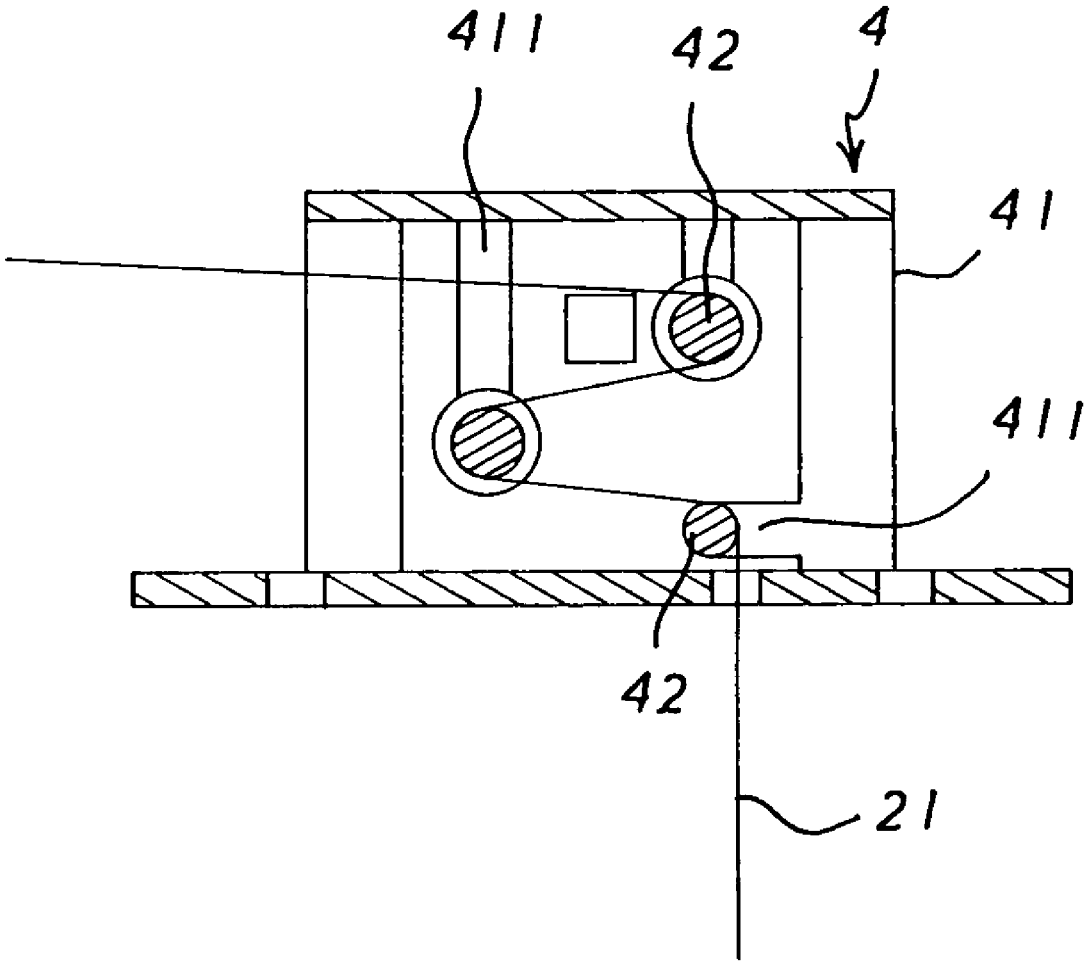
FIG. 4 is a plan cross-sectional view of the guide roller seat as shown in FIG. 2.
Figure 6:
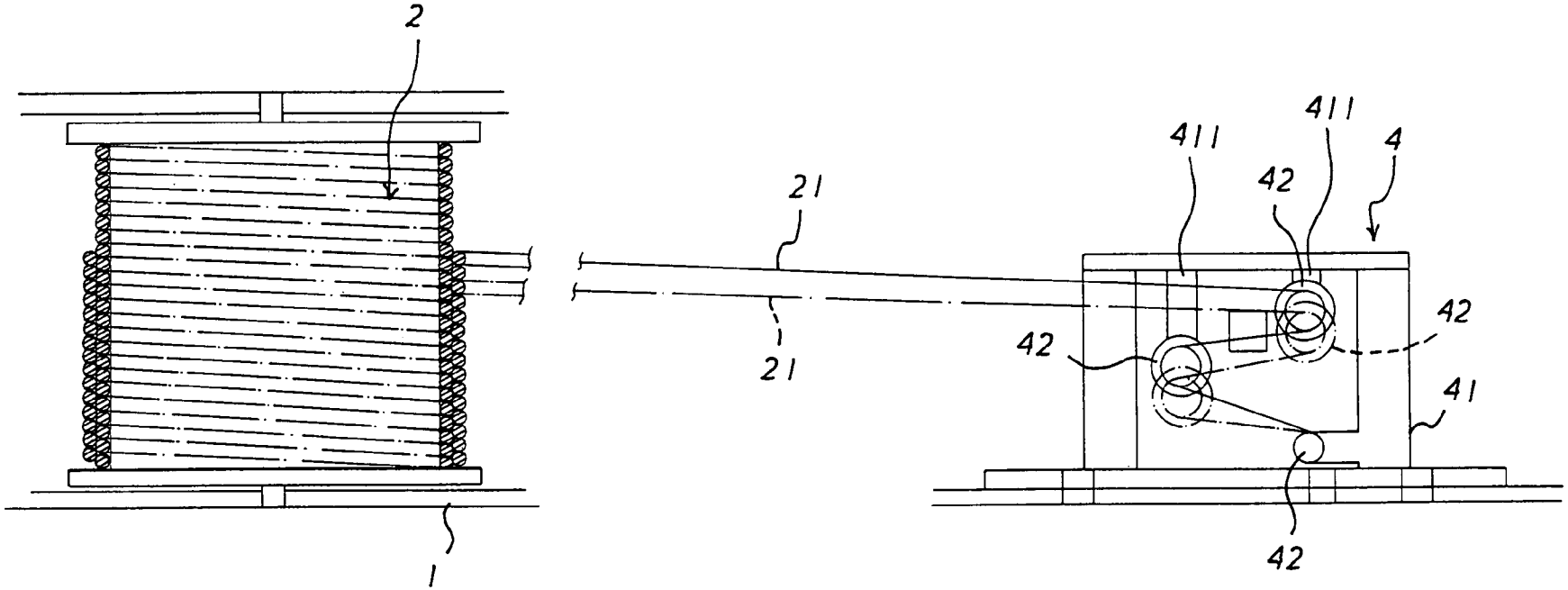
FIG. 6 is a plan cross-sectional operational view of the guide roller seat as shown in FIG. 2.

Referring to FIGS. 3 and 6, the seat body 41 of the guide roller seat 4 has a plurality of tracks 411 for mounting the guide rollers 42. The tracks 411 of the guide roller seat 4 are directed toward different directions. Each of the guide rollers 42 is rotatably movable in the respective track 411. When the position of the cord 21 is changed by the automatic winding mechanism 2, each of the guide rollers 42 is driven by the cord 21 to move in the respective track 411, so that the cord 21 is driven by the automatic winding mechanism 2 smoothly by movement of the guide rollers 42 to prevent the cord 21 from being tangled on the automatic winding mechanism 2, thereby facilitating operation of the cord 21.

Figure 7:
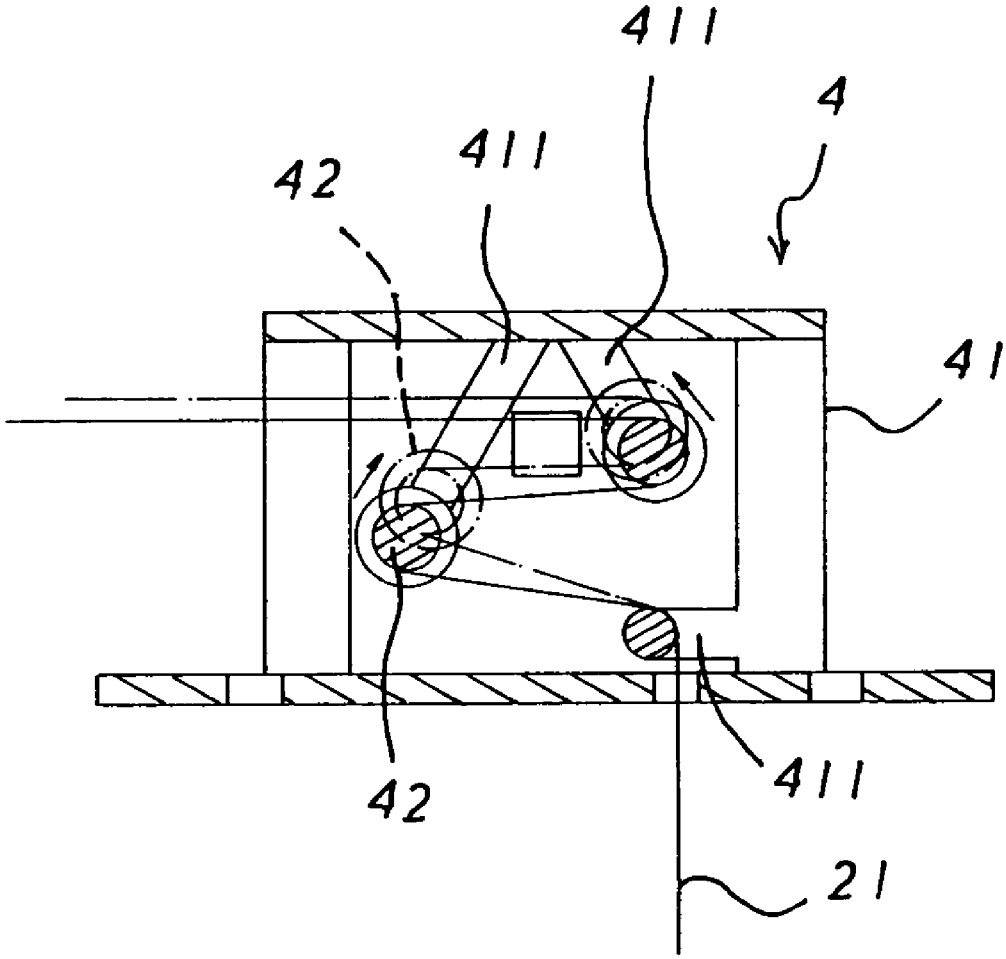
FIG. 7 is a plan cross-sectional operational view of a guide roller seat in accordance with another preferred embodiment of the present invention.

Referring to FIGS. 3 and 7, the tracks 411 of the guide roller seat 4 are directed toward a direction perpendicular to, parallel with or inclined relative to a horizontal axis. In addition, each of the tracks 411 of the guide roller seat 4 has a linear path.

Figure 8:
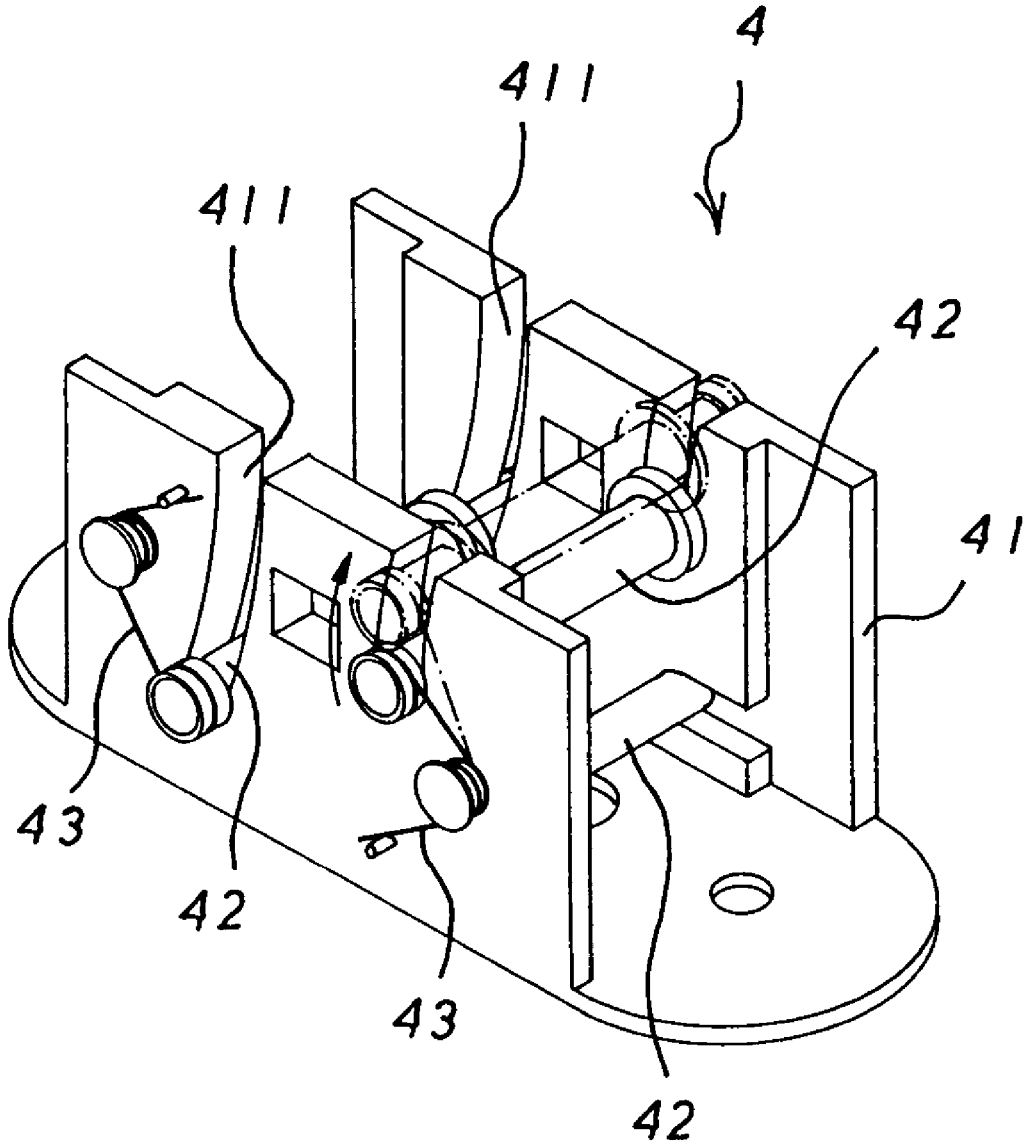
FIG. 8 is a perspective operational view of a guide roller seat in accordance with another preferred embodiment of the present invention.
Figure 9:
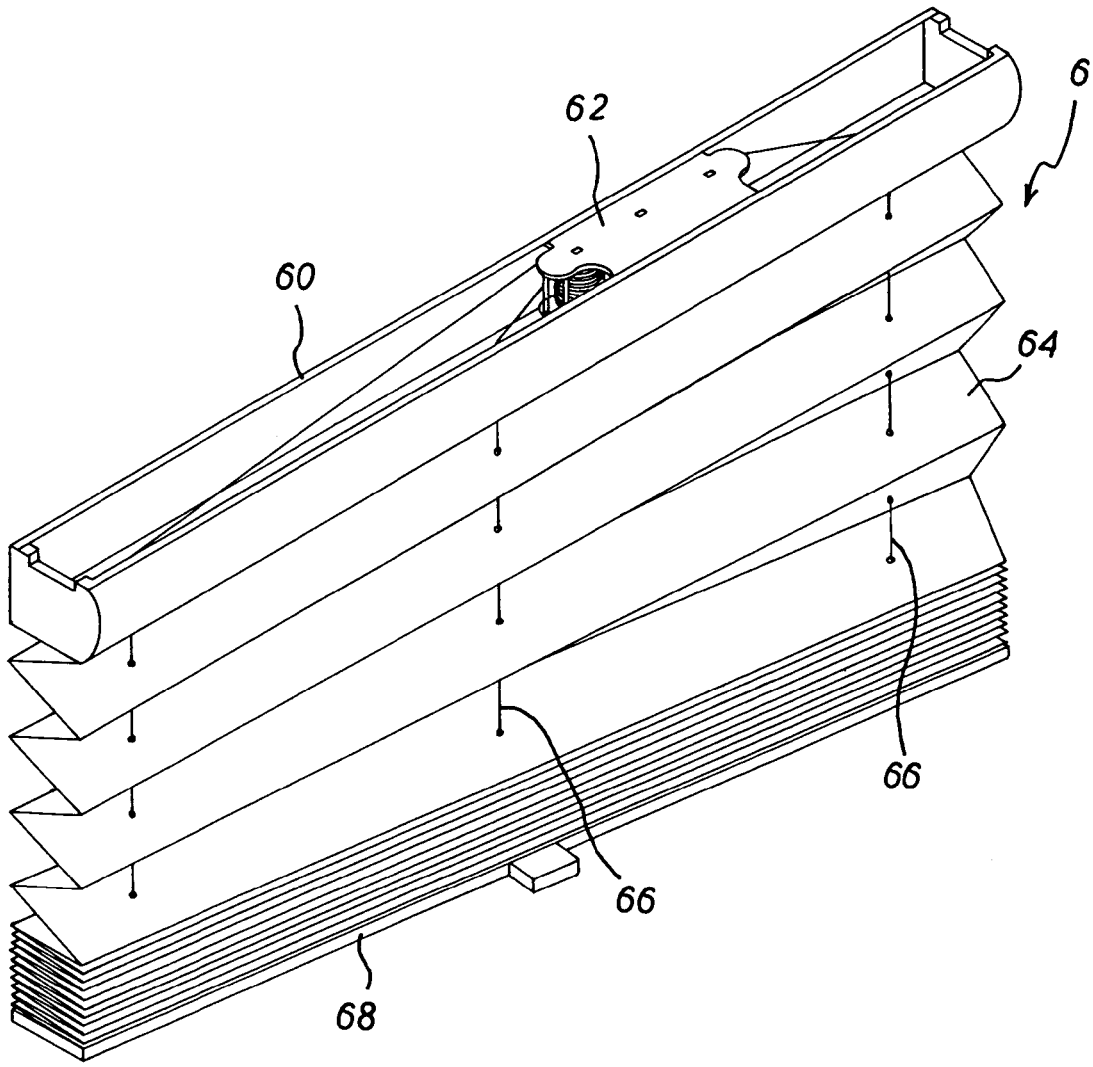
FIG.9 PRIOR ART
FIG. 9 is a perspective view of a conventional window covering in accordance with the prior art.

Referring to FIG. 8, each of the guide rollers 42 is pushed by an elastic member 43 mounted on the seat body 41, so that each of the guide rollers 42 is kept in an outer side of the respective track 411 at a normal state. Thus, when the cord 21 has a larger tension, each of the guide rollers 42 is moved toward an inner side of the respective track 411, and when the cord 21 has a smaller tension, each of the guide rollers 42 is moved toward the outer side of the respective track 411 by the restoring force of the elastic member 43, thereby facilitating operation of the automatic winding mechanism 2. In addition, one of the tracks 411 of the guide roller seat 4 has a curved path.

Accordingly, the cord 21 is kept at a normal state with a determined tension by a drawing action of the guide rollers 42 of the guide roller seat 4, so that the cord 21 has a determined tension to counteract an unevenly external force and to guide the unevenly external force to a correct direction, thereby preventing the cord 21 at one side of the headrail 1 from being pulled or loosened excessively due to the unevenly external force. In addition, the cord 21 is drawn by guidance of the guide rollers 42 of the guide roller seat 4 so as to fold or extend the covering body 3 smoothly and evenly, thereby preventing the covering body 3 from being tilted, so that the covering body 3 is kept at a horizontal state constantly during the drawing action of the cord 21, thereby facilitating a user operating the cord 21, and thereby enhancing the outer appearance of the covering body 3. Further, when the position of the cord 21 is changed by the automatic winding mechanism 2, each of the guide rollers 42 is driven by the cord 21 to move in the respective track 411, so that the cord 21 is driven by the automatic winding mechanism 2 smoothly by movement of the guide rollers 42 to prevent the cord 21 from being tangled on the automatic winding mechanism 2, thereby facilitating operation of the cord 21. Further, the guide roller seat 4 is arranged in a tangential direction of the automatic winding mechanism 2, and the cord 21 is reeved through each of the guide rollers 42 of the guide roller seat 4 in a tangential direction thereof, thereby preventing the cord 21 from slipping leftward and rightward relative to the guide rollers 42 of the guide roller seat 4, so that the cord 21 is moved smoothly, thereby facilitating a user operating the cord 21.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination of a guide roller seat and a window covering, comprising:

a seat body;

a plurality of guide rollers rotatably mounted in the seat body to guide movement of a cord which is extended between an automatic winding mechanism and a covering body of a window covering;

wherein the seat body of the guide roller seat has a plurality of tracks for mounting the guide rollers, and each of the guide rollers is rotatably movable in the respective track.

2. The combination of a guide roller seat and a window covering in accordance with claim 1, wherein the guide roller seat is arranged in a tangential direction of the automatic winding mechanism.

3. The combination of a guide roller seat and a window covering in accordance with claim 1, wherein the tracks of the guide roller seat are directed toward a direction perpendicular to, parallel with or inclined relative to a horizontal axis.

4. The combination of a guide roller seat and a window covering in accordance with claim 1, wherein each of the guide rollers is pushed by an elastic member mounted on the seat body, so that each of the guide rollers is kept in an outer side of the respective track at a normal state.

5. The combination of a guide roller seat and a window covering in accordance with claim 1, wherein the seat body is mounted in a headrail of the window covering.

6. The combination of a guide roller seat and a window covering in accordance with claim 1, wherein the cord of the window covering is reeved through each of the guide rollers and extended outward from the seat body.

7. The combination of a guide roller seat and a window covering in accordance with claim 1, wherein the cord is kept at a normal state with a determined tension by a drawing action of the guide rollers, so that the cord has a determined tension.

8. The combination of a guide roller seat and a window covering in accordance with claim 1, wherein the seat body is mounted on a bottom rail of the window covering.

9. The combination of a guide roller seat and a window covering in accordance with claim 1, wherein the cord is reeved through each of the guide rollers in a tangential direction thereof.

10. The combination of a guide roller seat and a window covering in accordance with claim 1, wherein the tracks are directed toward different directions.

11. The combination of a guide roller seat and a window covering in accordance with claim 1, wherein each of the tracks has a linear path.

12. The combination of a guide roller seat and a window covering in accordance with claim 1, wherein one of the tracks has a linear path.

13. The combination of a guide roller seat and a window covering in accordance with claim 1, wherein each of the tracks has a curved path.

14. The combination of a guide roller seat and a window covering in accordance with claim 1, wherein one of the tracks has a curved path.

* * * * *